United States Patent [19]

Fries

[11] 3,954,181

[45] May 4, 1976

[54] PARTS SORTING GAUGE

[75] Inventor: Timothy J. Fries, Rochester, N.Y.

[73] Assignee: General Motors Corporation, Detroit, Mich.

[22] Filed: July 28, 1975

[21] Appl. No.: 599,595

[52] U.S. Cl. ..... 209/85

[51] Int. Cl.[2] ..... B07B 13/04

[58] Field of Search ..... 299/82, 83, 85, 97, 299/93, 123

[56] References Cited

UNITED STATES PATENTS 2,615,567 10/1952 Campbell ..... 209/85 X 3,325,006 6/1967 Rindig ..... 209/85

*Primary Examiner*—Robert B. Reeves

*Assistant Examiner*—Charles A. Marmor

*Attorney, Agent, or Firm*—C. K. Veenstra

[57] ABSTRACT

A gauge for sorting defective cylindrical parts from satisfactory cylindrical parts has an upper plate with a plurality of vertical passages to orient the parts and a lower plate with several vertical bores disposed beneath each of the upper plate passages. The bores in the lower plate allow satisfactory parts to drop through but retain parts which are bent, which have a radially extending burr, or which are otherwise larger in diameter than the bore.

1 Claim, 5 Drawing Figures

PARTS SORTING GAUGE

This invention relates to a gauge for sorting defective cylindrical parts from satisfactory cylindrical parts.

In the mass production of cylindrical parts made by screw machines, it is necessary to check the parts after manufacture to remove from the high volume of parts produced those few parts which are defective because they are bent, because they have a radially extending burr, or because they are otherwise too large in diameter. This may be, and has been, readily accomplished by inserting the parts into a gauge. Satisfactory parts pass through the gauge, while a defective part is retained by the gauge.

In the normal gauging operation, however, a defective part must be cleared from the gauge before the gauge may be returned to service, thus requiring either the continuous attendance of an operator or an automatic gauge clearing device.

This invention provides a parts sorting gauge which readily passes the large number of satisfactory parts while retaining the occasional defective part and yet which remains in continuous service without requiring an operator in continuous attendance and without requiring an automatic gauge clearing device.

In the gauge provided by this invention, a plurality of vertical passages are disposed in an upper stratum to orient the parts, and several vertical bores are disposed in a lower stratum beneath each of the passages. The bores pass the satisfactory parts while retaining the defective parts. The gauge is provided with a sufficient number of passages and bores so that the bores will not be obstructed by the small proportion of defective parts which may be received over a certain period of time — for example, one day or one shift.

With this invention, therefore, parts may be continuously sorted as they are manufactured with the satisfactory parts passing through the gauge to other production operations and with defective parts being retained by the gauge, and the gauge need be cleared by an operator only infrequently — for example, at the end of each day or shift.

The details as well as other objects and advantages of this invention are set forth in the remainder of the specification and in the accompanying drawing in which.

Figure 1:
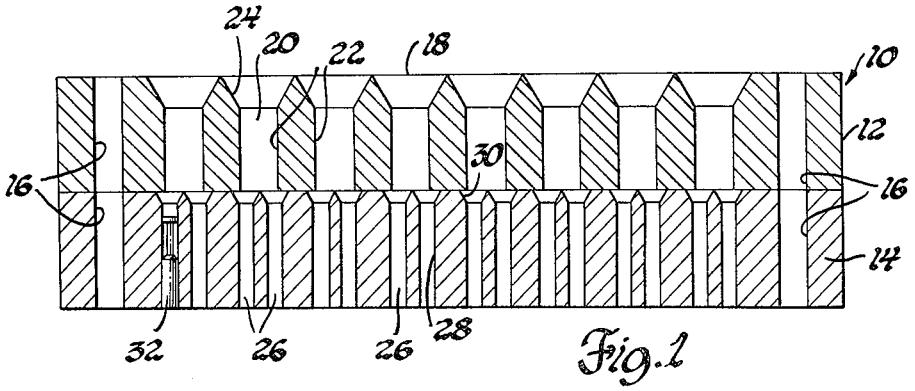
FIG. 1 is a sectional elevational view through the gauge, taken along line A—A of FIG. 2 and B—B of FIG. 3, showing the vertical orienting passages and gauging bores, with one of the bores having a defective part retained therein.

Referring to the drawing, a parts sorting gauge 10 has an upper plate 12 defining a parts orienting stratum and a lower plate 14 defining a parts sorting stratum. Plates 12 and 14 have aligned holes 16 which may receive pins (not shown) to align and maintain plates 12 and 14 in assembly.

Figure 2:
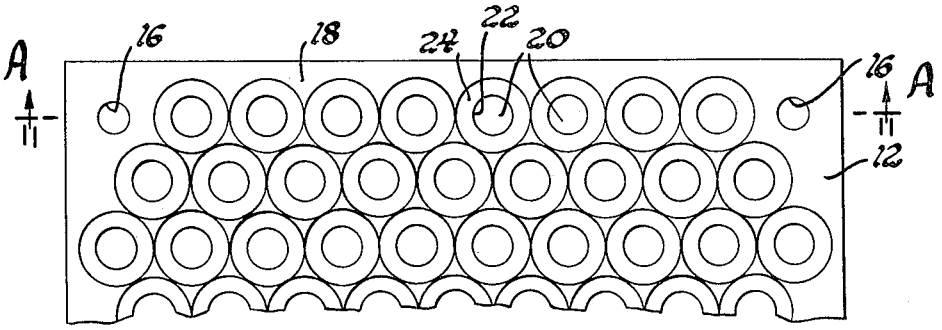
FIG. 2 is a top plan view of the plate forming the upper stratum and showing the tangentially disposed parts orienting passages.

The top surface 18 of upper plate 12 is horizontal and defines a parts receiving surface. A plurality of vertical parts orienting passages 20 extend downwardly from parts receiving surface 18, each passage having a straight region 22 and a tapered region 24. Tapered regions 24 decrease in diameter from the parts receiving surface 18 to the straight regions 22 and, as is apparent from FIG. 2, tangentially intersect other tapered regions.

Figure 3:
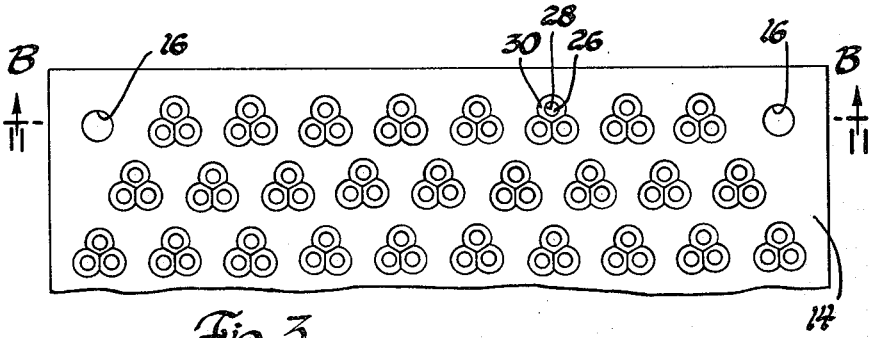
FIG. 3 is a top plan view of the lower stratum showing the parts gauging bores grouped therein.
Figure 4:
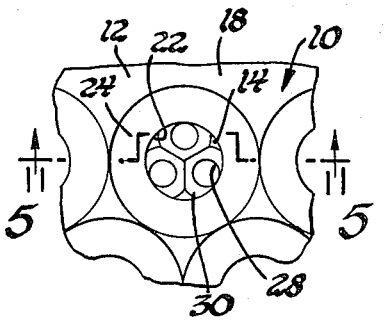
FIG. 4 is an enlarged top plan view of the FIG. 1 assembly showing the parts gauging bores aligned below a parts orienting passage.
Figure 5:
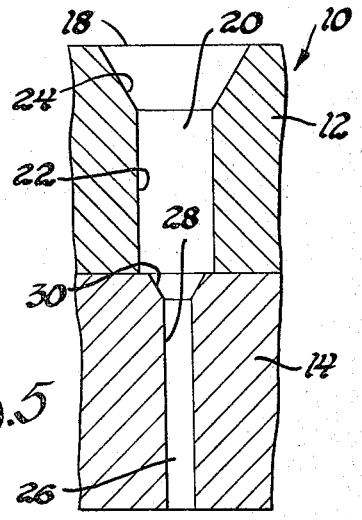
FIG. 5 is an enlarged sectional view along line 5—5 of FIG. 4 showing a parts gauging bore disposed below a parts orienting passage.

Lower plate 14 has a plurality of vertical parts gauging bores 26, here shown as three, disposed beneath each of the upper plate passages 20. Each bore has a straight section 28 and a tapered section 30. Each tapered section 30 decreases in diameter from the associated passage 20 to its straight section 28 and, as is apparent from FIG. 3, intersects the tapered sections of other bores disposed beneath the associated passage 20.

In operation, parts are received on upper surface 18 and drop into passages 20 where they are maintained in a substantially vertical orientation. The intersecting matrix of tapered regions 24 assures that the parts will not remain horizontally on upper surface 18 but will fall into one of the passages 20. Furthermore, if an occasional part does lie momentarily balanced on surface 18 between passages 20, it eventually will be struck by another part and thus dislodged into one of passages 20 or it will be vibrated, either directly or indirectly by operation of other equipment, and thus fall into one of passages 20.

As parts are oriented vertically in passages 20, they drop into gauging bores 26, the intersecting tapered sections 30 of bores 26 assuring that a part will not remain lodged in a passage 20.

The straight sections 28 of bores 26 has substantially identical diameters and retain the parts, such as that shown at 32 in FIG. 1, which are bent, which have a radially extending burr, or which are otherwise larger in diameter than the straight sections 28 or bores 26.

Gauge 10 is provided with sufficient passages 20 and bores 26 to assure that a large number of bores 26 will remain unobstructed over a long period of time — for example, one day or one shift. Thus gauge 10 need be cleared of defective parts only infrequently. Moreover, gauge 10 may be cleared quickly and easily simply by inverting it over a defective parts bin, although occasionally it must be rapped on the edge of the bin to dislodge a part which has become struck.

One embodiment of this gauge has been designed to sort parts delivered from a machine at the rate of one part per second with about one percent of the parts being defective. The upper stratum or plate 12 had 101 orienting passages 20 each having a one-fourth inch diameter straight region 22 and a tapered region 24 opening to a ½ inch diameter circle in top surface 18. The lower stratum or plate 14 had 303 gauging bores 26 — three below each passage 20 — and each bore had a 0.0930 inch diameter straight section 28 and a tapered section 30 opening to a 3/16 inch diameter circle in the top surface of plate 14. In a period of four hours more than 14,200 satisfactory parts pass through the gauge and about 144 defective parts are retained. The gauge is then cleared and returned to service, although the gauge could be expected to remain operative for about 4 hours more without clearing.

The embodiments of the invention in which an exclusive property or privilege is claimed are defined as follows:

1. A gauge for sorting defective cylindrical parts from satisfactory cylindrical parts, said gauge comprising a parts orienting stratum and a parts sorting stratum disposed beneath said orienting stratum, said orienting stratum having a horizontal parts receiving surface and a plurality of vertical passages extending downwardly therefrom, each of said passages including a straight region for maintaining parts in a substantially vertical orientation, each of said passages further including a tapered region disposed above said straight region and decreasing in diameter from said parts receiving surface to said straight region for guiding parts from said receiving surface into said straight region, each of said tapered regions intersecting other of said tapered regions to minimize the possibility that a part will remain horizontally on said parts receiving surface, said sorting stratum having a plurality of vertical bores disposed beneath each of said passages, each of said bores including a straight section having a diameter substantially identical to the diameter of the straight sections of the other bores for permitting proper cylindrical parts to pass therethrough but to retain cylindrical parts which are bent, which have a radially extending burr, or which are otherwise larger in diameter than said straight section, each of said bores further including a tapered section disposed between the straight region of the associated passage and said straight section of said bore and decreasing in diameter from said passage to said straight section of said bore for guiding parts from said orienting stratum to said straight section of said bore, each of said tapered sections intersecting other of said tapered sections to minimize the possibility that a part will remain in said orienting stratum.

* * * * *